United States Patent [19]

Roeker

[11] 4,429,455

[45] Feb. 7, 1984

[54] CONNECTOR APPLICATION MACHINE

[75] Inventor: David C. Roeker, Hudson, Wis.

[73] Assignee: Minnesota Mining and Manufacturing Company, Saint Paul, Minn.

[21] Appl. No.: 345,334

[22] Filed: Feb. 3, 1982

[51] Int. Cl.[3] ..... H01R 43/04

[52] U.S. Cl. ..... 29/749; 29/753; 29/759

[58] Field of Search ..... 29/749, 753, 754, 760, 29/759

[56] References Cited

U.S. PATENT DOCUMENTS 4,281,442 8/1981 Senior et al. ..... 29/749 X 4,393,580 7/1983 Hall, Jr. ..... 29/749

*Primary Examiner*—Carl E. Hall

*Attorney, Agent, or Firm*—Donald M. Sell; James A. Smith; Terryl K. Qualey

[57] ABSTRACT

A machine for application of two-part electrical connectors to multiconductor flat cables has connector magazines for feeding connector bodies and covers to a pre-application station seriatim, and a connector pusher bar for moving a body and a cover from a pre-application station to an application station, one connector part above and one below a flat cable path through the application station. The upper connector part is supported and guided between a pair of plates, one of which has its lower edge inclined toward the opposing plate to provide support for the connector part between the plates, and the plates are resiliently movable apart to permit a platen to push the upper connector part past the inclined support edge and to press it into engagement with the flat cable and the other connector part to complete the application.

5 Claims, 10 Drawing Figures

CONNECTOR APPLICATION MACHINE

FIELD OF THE INVENTION

The present invention relates to a machine for applying electrical connectors having insulation displacement contact elements to multiconductor flat cables.

BACKGROUND OF THE INVENTION

Electrical connectors having insulation displacement contact elements are usually applied to multiconductor flat cables individually in a manual crimping press. For most applications this has proven satisfactory. However, in high volume applications the handling of each individual connector is too time consuming.

U.S. Pat. No. 4,281,442 discloses a machine for applying connectors to multiconductor flat cables substantially automatically, including the automatic feeding of the connector parts and the cable. The machine is, however, more complex and expensive than desirable.

SUMMARY OF THE INVENTION

The present invention provides a machine for applying two-part electrical connectors having insulation displacement contact elements to multiconductor flat cables. It has a central application station having a multiconductor flat cable path with means for locating a multiconductor flat cable widthwise to position the conductors thereof at predetermined positions, a body magazine extending to one side of the application station for holding a multiplicity of connector bodies and a cover magazine extending to the opposite side of the application station for holding a multiplicity of connector covers. The body and cover magazines are in side-to-side alignment and lie behind the cable path with one magazine above and one below the plane of the flat cable path at the application station. A pre-application station is located between the body magazine and the cover magazine and lies in front-to-back alignment with the application station and means are provided for urging the connector bodies and the connector covers in the magazines seriatim into the pre-application station. Support and guide means extend from the pre-application station to the application station for supporting and guiding a body and a cover from the pre-application station to the application station. The support and guide means includes a pair of spaced plates, one of which has its lower edge turned inward through an acute angle toward the opposing plate to define an inclined edge for supporting and guiding the upper connector part from the pre-application station to the application station. The plates are spaced to support the upper connector part between them on the inclined edge and they are resiliently movable apart to permit the upper connector part to be pushed past the inclined edge. Means extend between the connector guide and support plates at the application station for pushing an upper connector part past the inclined support edge and for pressing a connector body and cover together with a flat cable between them to electrically connect the contact elements to the conductors of the flat cable.

THE DRAWING

DESCRIPTION OF THE PREFERRED EMBODIMENT

Figure 1:
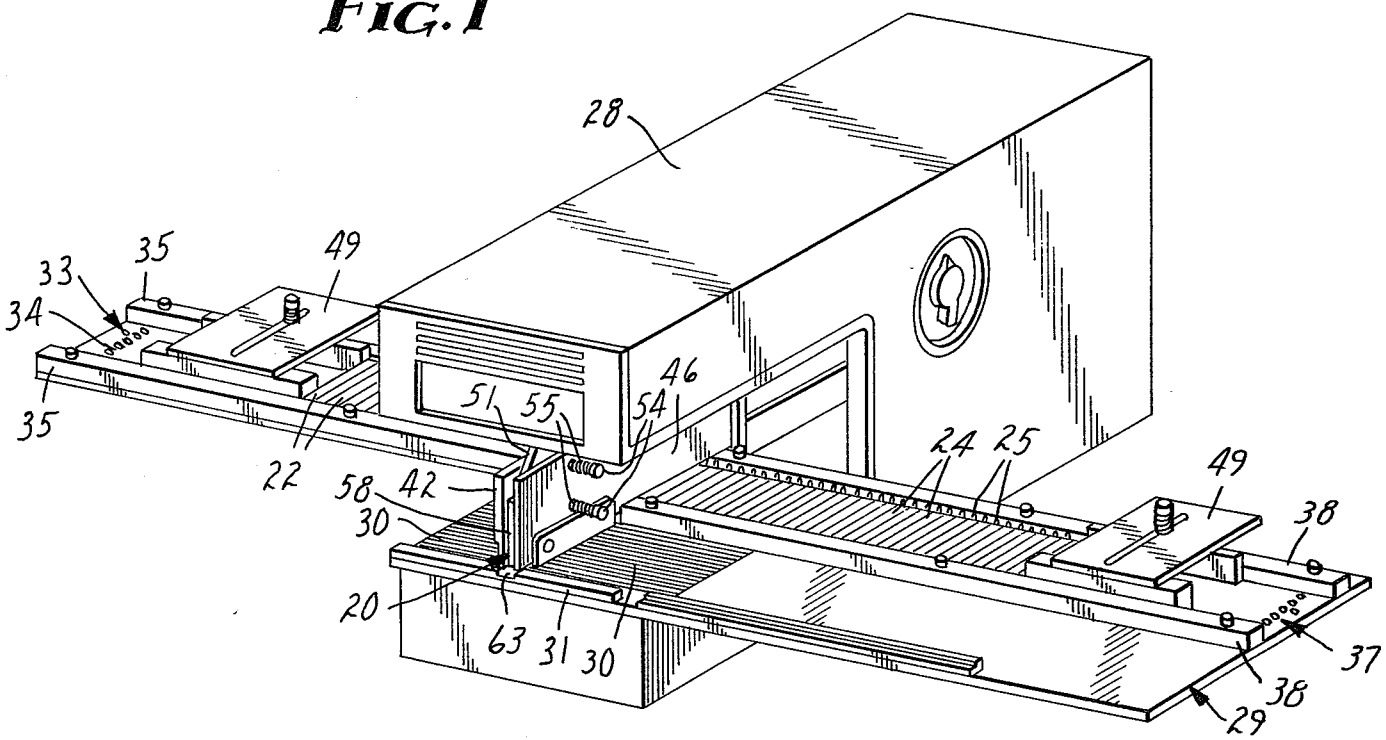
FIG. 1 is a perspective view showing the front, right side and top of a connector application machine constructed in accordance with the present invention.
Figure 3:
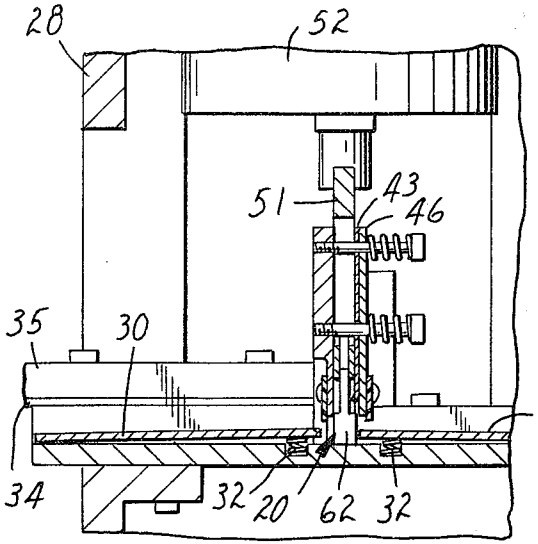
FIG. 3 is a partial front elevation view of the machine, partially in section.
Figure 2:
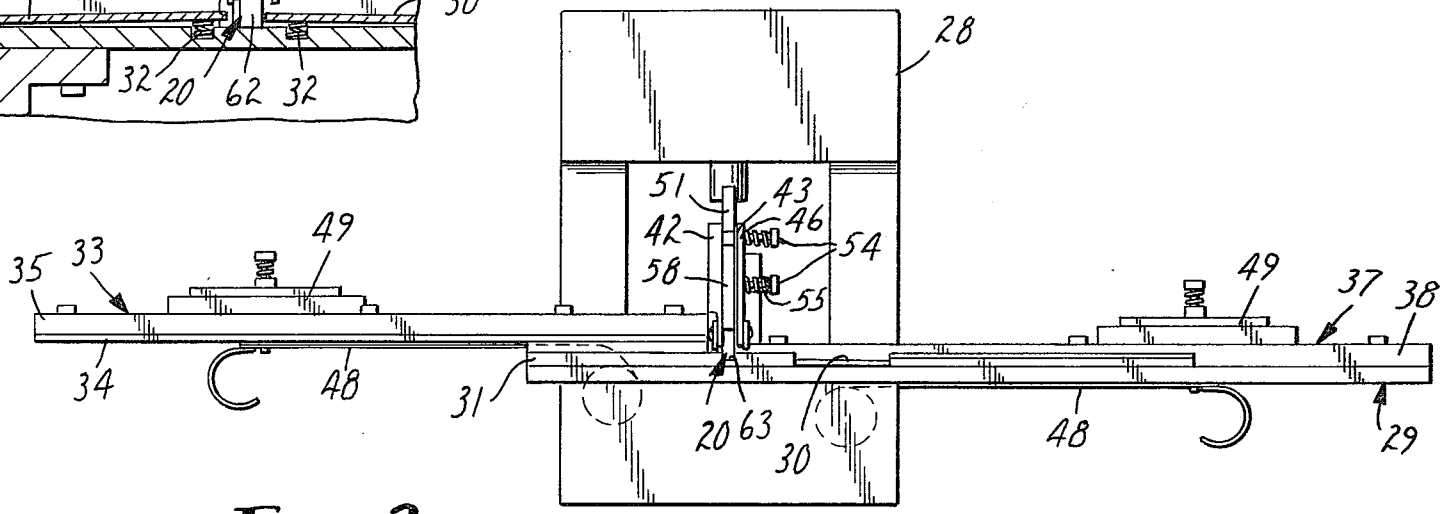
FIG. 2 is a front elevation view of the machine.

The connector application machine has a central application station 20 at which a connector, consisting of a connector body 22 having insulation displacement contacts 23 and a cover 24 having end latches 25, is to be applied to a multiconductor flat cable 27. The illustrated machine is constructed for use with a multiconductor flat cable 27 in which at least one surface of the plastic web interconnecting the conductors is grooved between conductors. More particularly, it is constructed for application of socket connectors to multiconductor flat cables, both of which are sold under the trademark Scotchflex by Minnesota Mining and Manufacturing Company, the assignee of the present application.

The main supporting structure for the machine is a rectangular cast iron housing 28 which is generally U-shaped in side view to provide an open working area between the legs of the U. The base of the application station 20 is an area on an elongate rectangular base plate 29 between a pair of cable guide plates 30 attached to the upper surface of the base plate 29. The upper surface of each guide plate 30 is formed with ridges complementary to the grooves in the cable 27 to provide for precise positioning of the conductors of the cable.

A rail 31 attached to the upper surface of the base plate 29 extends along the forward edge of the guide plates 30 and further out onto the base plate 29 to provide an initial edge guide for the cable 27 so that the operator, by pushing the cable 27 against the rail 31 will align each groove in the cable with the proper ridges on the guide plates 30. The rail 31 also provides a connector cover stop at the application station for positioning the forward end of the cover 24 to align it with the predetermined conductor positions defined between the ridges on the cable guide plates 30.

The cable guide plates 30 are spaced slightly greater than the width of the connector covers 24. Their ends adjacent the application station are urged upward by springs 32 so that their upper surfaces adjacent the application station are normally spaced from the base plate 29 a distance slightly greater than the thickness of the covers. Thus, after a cover 24 is received in the area between the guide plates a cable 27 may be slid across the guide plates 30 and aligned by the grooves therein with a cover 24 in position below the cable. The springs 32 permit the operator to depress one of the guide plates 30 as he slides the cable 27 across it whereupon the edge of the other guide plate acts as a stop for the cable end to position the cable for application of a connector to the end of the cable.

A connector body magazine 33, defined by a flat plate 34 and a pair of parallel guide rails 35, extends to one side of the application station for holding a multiplicity of connector bodies 22 above the plane of the flat cable path across the guide plates 30 at the application station 20. A connector cover magazine 37, defined by the upper surface of the base plate 29 and a pair of guide rails 38 extends to the opposite side of the application station for holding a multiplicity of connector covers 24 below the plane of the flat cable path at the application station 20. The body and cover magazines 33 and 37 are in side-to-side alignment and lie behind and parallel to the cable guide path.

A pre-application station 40 is defined between the connector body magazine 33 and the connector cover magazine 37 in front-to-back alignment with the application station 20 between a pair of support and guide plates 42 and 43 that extend from the pre-application station 40 to the application station 20. Plate 42 has an opening 45 through which the connector bodies 22 enter the pre-application station 40 from the body magazine 33. Plate 43 is a thin plate and has its lower edge turned inward through an acute angle toward the heavy plate 42 to define an inclined edge for supporting and guiding the connector bodies 22 from the pre-application station 40 to the application station 20. Plate 43 is backed by a heavier plate 46. The pre-application position for the covers 24 is defined against the face of the heavier plate 42 below the body opening 45 therein and there is a space between the base plate 29 and the backing plate 46 through which the covers 24 can pass from the cover magazine 33 into the pre-application station 40. Each of the magazines 33 and 37 has a connector follower 49 which is normally urged toward the pre-application station 40 by a constant force spring 48 to urge connector bodies and connector covers in the magazines seriatim into the pre-application station 40. At the pre-application station 40 a connector body 22 is urged against the thin plate 43 above the inclined support edge 44 thereof and a connector cover 24 is urged against the face of the plate 42 below and in alignment with the body.

A crimping platen 51, attached to the piston of an air cylinder 52, extends between the support and guide plates 42 and 43 and spaces them apart a distance slightly greater than the width of the connector parts. Three screws 54 pass freely through openings in backing plate 46 and guide plate 43 and are threaded into the opposite guide plate 42, and a compression spring 55 is captured between the head of each screw 54 and the surface of backing plate 46. The platen 51 is formed with a vertical slot through which the forward two screws 54 pass to guide the platen and permit it to move vertically between the guide plates 42 and 43. The springs 55 permit the guide plate 43 and backing plate 46 to be resiliently moved away from the guide plate 42 so that the platen 51 can push a connector body 22 supported on the inclined edge 44 of the guide plate 43 at the application station 20 past the inclined edge and against the cable 27. A connector body stop 58 extends downward from the forward edge of the platen 51 to provide a stop for the forward end of a connector body 22 to align the connector body with a connector cover 24 and a cable 27 at the application station 20.

Figure 4:
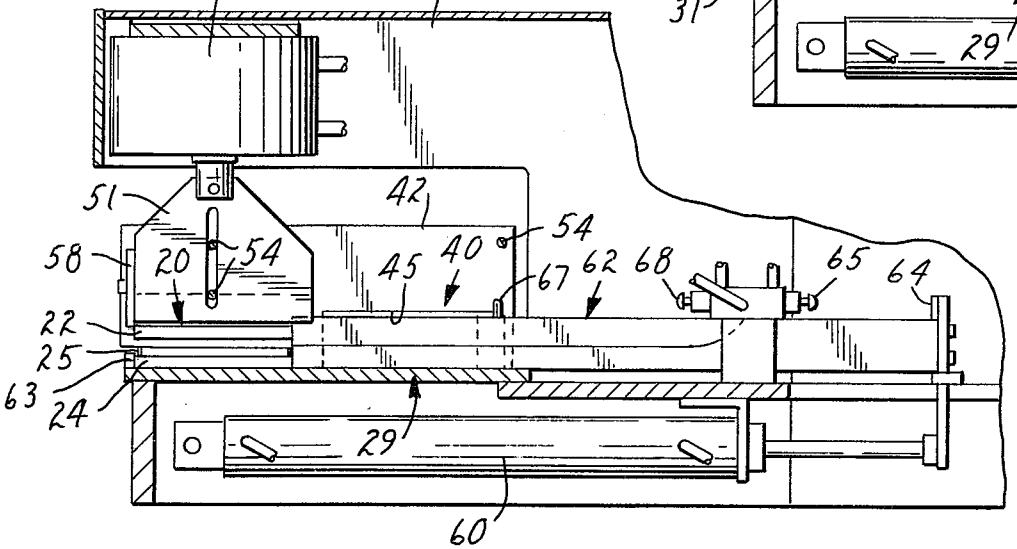
FIG. 4 is a side elevation view, partially in section, of the machine in its home position.

The piston of an air cylinder 60 is connected to a pusher bar 62 to provide for movement of a connector body and cover from the pre-application station 40 to the application station 20. The pusher bar 62 has a flat forward end to simultaneously engage the trailing end of a body and a cover. In its normal home position the pusher bar 62 pushes a connector body 22 and a cover 24 against the body stop 58 and the rail 31, respectively, at the application station 20 (see FIG. 4). Air pressure is continuously applied to the cylinder 60 so that the pusher bar 62 maintains pressure on the connector body 22 urging it against the body stop 58; a slightly greater spacing being provided for the cover to assure that the pusher bar 62 applies the pressure to the connector body 22 for a purpose which will be hereinafter described.

Figure 5:
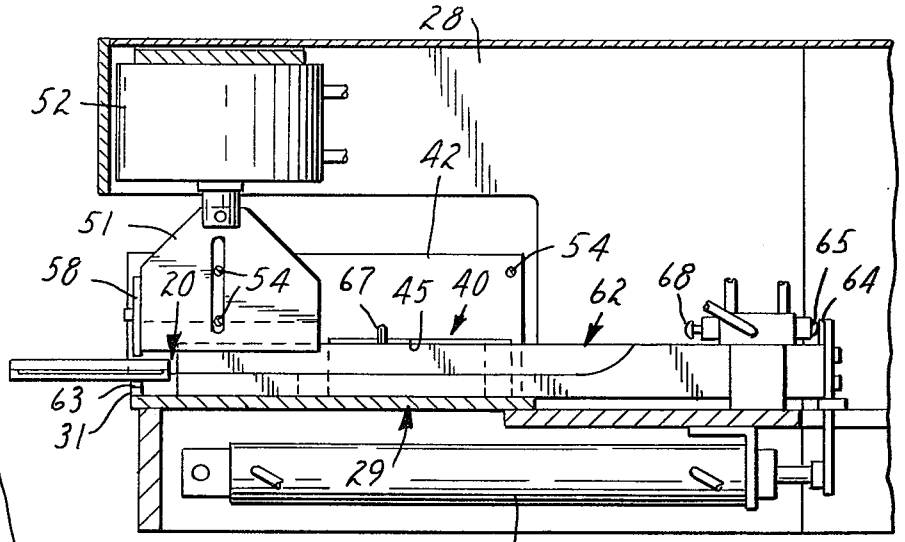
FIG. 5 is a side elevation view similar to that of FIG. 4 of the machine in the connector ejection position.
Figure 9:
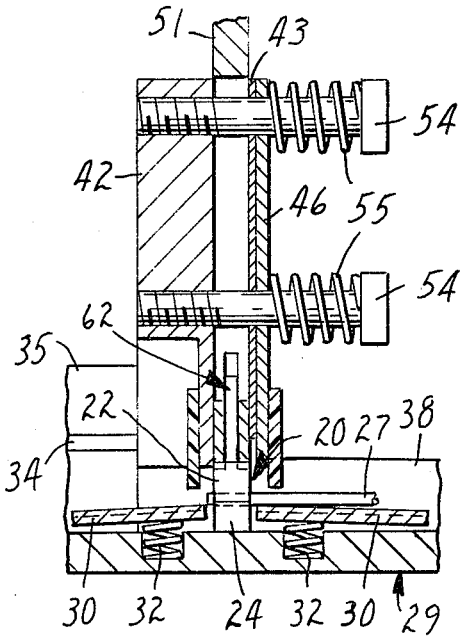
FIG. 9 is a view similar to that of FIG. 8 after the connector has been applied to the multiconductor flat cable.
Figure 10:
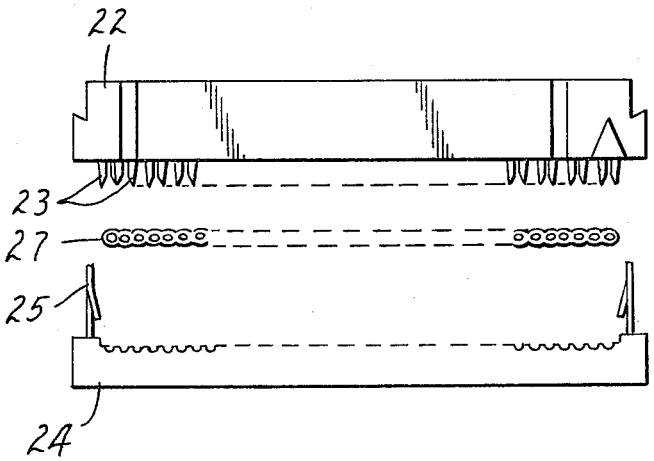
FIG. 10 is a side elevation view of a connector body and a connector cover with a multiconductor flat cable between them in their relative positions just prior to application in the machine.

Upon actuation, the crimping air cylinder 52 drives the platen 51 from its normally retracted position to an extended position to push a connector body 22 past the inclined support edge 44 and to press the connector body 22 and cover 24 together with a flat cable 27 between them to complete the connector application. The lower end of the platen 51 has a central longitudinal slot and the upper edge of the pusher bar 62 is made slightly narrower than the slot so that the platen 51 can straddle a portion of the end of the pusher bar 62 in the crimping operation (see FIG. 9) to permit various lengths of connectors to be applied. When the crimping action is completed the platen 51 is retracted and the pressure of the pusher bar 62 on the connected body 22 pushing it against the stop 58 on the platen 51 causes the entire connector and the connected cable to be raised up with the platen. The connector and cable are raised by the platen until the upper surface of the connector body 22 contacts the inclined edge 44 of the support plate 43 which strips the completed connector off of the stop 58 in a connector exit space between the stop 58 and a cutout area 63 in the rail 31. The continued air pressure applied to the feed cylinder 60 urges the pusher bar 62 forward causing the now unrestrained connector and connected cable to be ejected from the application station 20 through the connector exit space (see FIG. 5).

Figure 6:
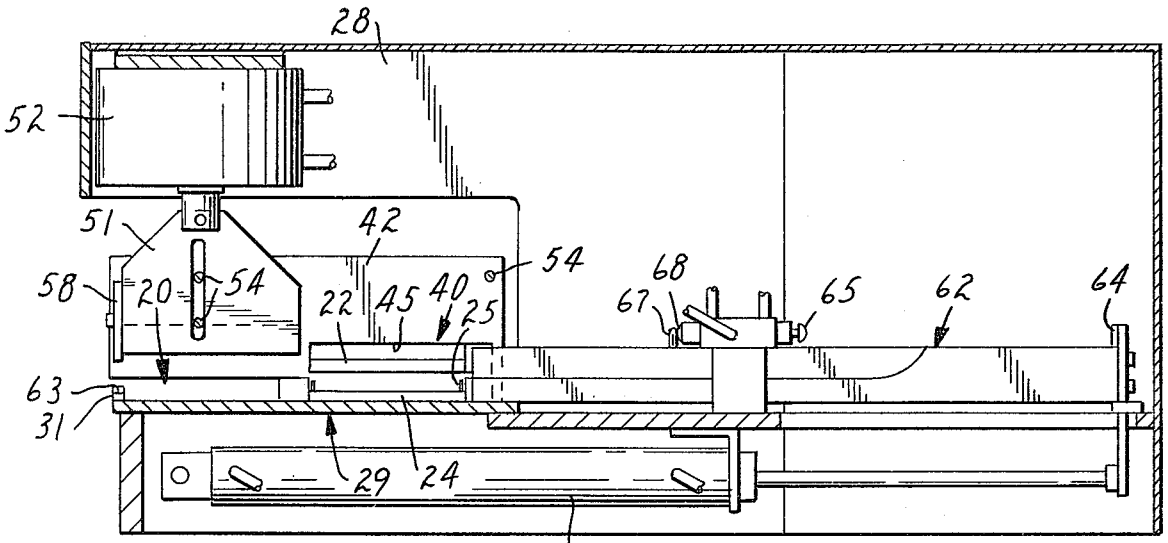
FIG. 6 is a similar side elevation view of the machine at the beginning of the connector feed cycle.
Figure 7:
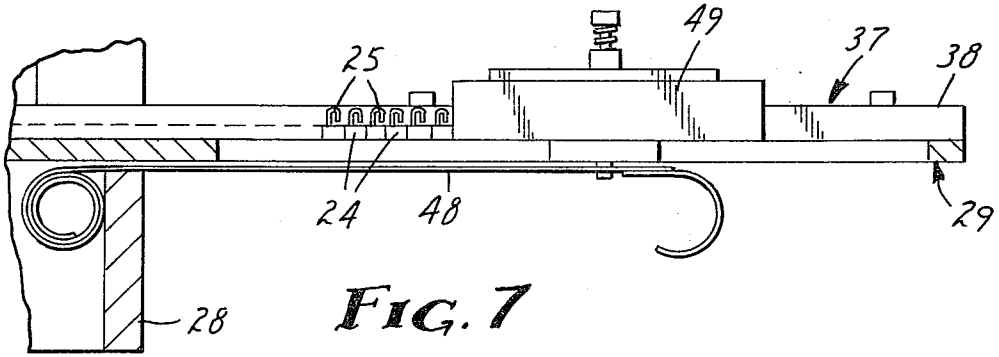
FIG. 7 is a side elevation view of the connector cover magazine of the machine, partially in section.
Figure 8:
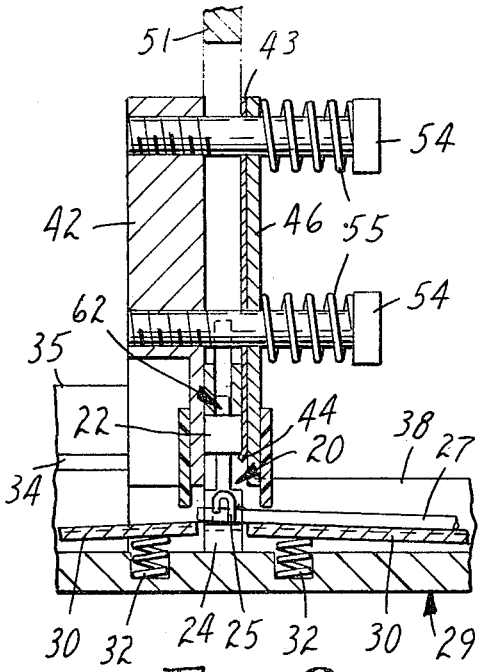
FIG. 8 is a front elevation view of the connector application station of the machine, partially in section with the connector parts in position for application.

A switch button 64 is mounted at the trailing end of the pusher bar 62 to contact an air pressure control switch 65 after ejection of the completed connector to reverse the air pressure in the feed cylinder 60 to retract the pusher bar 62. After the pusher bar is retracted past the pre-application station 40 a connector body 22 and cover 24 are urged by the connector followers 49 and springs 48 into the pre-application station 40. A second switch button 67 is provided toward the forward end of the pusher bar 62 to contact a forward air pressure switch 68 after the pusher bar 62 has been retracted past the pre-application station 40 (see FIG. 6) to again reverse the air pressure in the feed cylinder 60 and drive the pusher bar 62 forward. The pusher bar then pushes the body 22 and cover 24 in the pre-application station 40 forward until the connector body 22 contacts the stop 58 whereupon the machine is again at the home position (FIG. 4) with the pusher bar 62 maintaining pressure on the connector body 22 and in ready position for the operator to move a cable 27 into position for connection.

I claim:

1. A machine for applying two part electrical connectors having insulation displacement contact elements to multiconductor flat cables, comprising:

a central application station having a multiconductor flat cable path with means for locating a multiconductor flat cable widthwise to position the conductors thereof at predetermined positions, a body magazine extending to one side of said application station for holding a multiplicity of connector bodies, a cover magazine extending to the opposite side of said application station for holding a multiplicity of connector covers, said body and cover magazines being in side-to-side alignment and lying behind said multiconductor flat cable path with one magazine above and one below the plane of said flat cable path at said application station, a pre-application station between said body magazine and said cover magazine and in front-to-back alignment with said application station, means for urging connector bodies and connector covers in said magazines seriatim into said pre-application station, support and guide means extending from said pre-application station to said application station for supporting and guiding a body and a cover from said pre-application station to said application station; said support and guide means including a pair of spaced plates, one of which has its lower edge turned inward through an acute angle toward the opposing plate to define an inclined edge for supporting and guiding the upper connector part from said pre-application station to said application station, said plates being spaced to support the upper connector part between them on said inclined edge and being resiliently movable apart to permit the upper connector part to be pushed past said inclined edge, and means at said application station extending between said connector guide and support plates for pushing an upper connector part past said inclined support edge and for pressing a connector body and cover together with a flat cable between them to electrically connect the contact elements to the conductors of the flat cable.

2. The machine of claim 1 wherein said means for pushing a connector body and a connector cover from said pre-application station to said application station comprises:

an air cylinder, a connector pusher bar connected to the piston of said air cylinder and formed to simultaneously push a body and a cover from said pre-application station to said application station, a connector body stop and a connector cover stop at said application station for stopping a connector body and a connector cover pushed by said pusher bar, said stops being positioned to align a connector body and a connector cover with each other and with said predetermined conductor positions, and air cylinder control means to cause said pusher bar to normally push a body and a cover against said stops and maintain pressure on at least one of them and, upon pressing together of the connector parts at said application station to retract past said pre-application station and then move forward to push another body and cover from said pre-application station to said application station against said stops.

3. The machine of claim 2 wherein said means for pushing an upper connector part includes a platen movable between said connector guide and support plates from a normally retracted position to an extended position to push the upper connector part past said inclined support edge and to press the connector body and cover together with a flat cable between them to complete the connector application, said stop for the upper connector part is on said platen and said pusher bar normally maintains pressure only on the upper connector part so that upon retraction of said platen after completing the connector application, the connector and cable are lifted with said platen, a connector exit space is provided at said application station between said body and cover stops when said platen is in its normally retracted position, said inclined edge of said guide and support plate is positioned such that upon retraction of said platen after pressing, the connector carried by the platen is arrested by the inclined edge and stripped from the platen in alignment with the connector exit space, and said air cylinder control means causes said bar to continue forward to eject the applied connector through the connector exit space prior to retraction to engage another body and cover.

4. The machine of claim 3 wherein said means for pushing an upper connector part includes an air cylinder for driving said platen.

5. The machine of claim 1 for use with a multiconductor flat cable having grooves between the parallel conductors thereof wherein said means for locating a multiconductor flat cable widthwise at said application station comprises parallel ridges complementary to the grooves between conductors of a said cable.

* * * * *